US005862840A

United States Patent [19]

Hansen

[11] Patent Number: 5,862,840

[45] Date of Patent: Jan. 26, 1999

[54] DEVICE FOR STERILE FILLING OF CONTAINERS

[76] Inventor: Bernd Hansen, Heerstrasse 16, D-74429 Sulzbach-Laufen, Germany

[21] Appl. No.: 561,195

[22] Filed: Nov. 21, 1995

Related U.S. Application Data

[63] Continuation-in-part of Ser. No. 398,692, Mar. 6, 1995, abandoned.

[30] Foreign Application Priority Data

Mar. 21, 1994 [DE] Germany ..... 44 09 617.8

[51] Int. Cl.[6] ..... B65B 55/00

[52] U.S. Cl. ..... 141/90; 141/87; 141/91; 141/284; 141/329

[58] Field of Search ..... 141/87, 89–91, 141/97, 130, 251, 258, 260, 284, 329

[56] References Cited

U.S. PATENT DOCUMENTS

| | | | |
|---|---|---|---|
| 2,874,734 | 2/1959 | Luckock | 141/87 |
| 3,765,142 | 10/1973 | Lindquist et al. | 141/91 |
| 4,342,341 | 8/1982 | Lee | 141/90 |
| 4,350,187 | 9/1982 | Trusselle | 141/90 |
| 4,446,674 | 5/1984 | Inada | 53/502 |
| 4,572,252 | 2/1986 | Ponzi | 141/90 |
| 4,699,297 | 10/1987 | Raque | 222/148 |
| 4,872,494 | 10/1989 | Coccia | 141/97 |
| 4,964,444 | 10/1990 | Hanerus et al. | 141/90 |
| 5,012,845 | 5/1991 | Averette | 141/329 |

*Primary Examiner*—J. Casimer Jacyna
*Attorney, Agent, or Firm*—Roylance, Abrams, Berdo & Goodman, L.L.P.

[57] ABSTRACT

In a device for sterile filling of containers, especially before removal of the container from the mold of a blow molding machine used for its manufacture, a sterile filling chamber housing is constructed to be pressure-resistant and is provided with connections for feeding and discharging of cleaning fluid, vapor and sterile air. Each opening present in the floor of the sterile filling chamber housing for the passage of a filling tap can be closed tightly by a movable shutter. The shutter engages tightly on the outside of the housing floor.

23 Claims, 8 Drawing Sheets

25
26
13a
23
10'
18
12'
13
24
14
15
17
10
16
12"
22
21
11
12
1
19
20
1'
1'
3
3
4
5
8
2
7
9
6
6'

25
25
25
10'
12'
17
17
10
18
12'
15
14
15
11
11
12
12"
1"
1
16
20
1"
3
2
4

25
25
10'
18
12'
12'
10
10
14
12"
12"
19
11
1"
20
4
4

235
234
212
229
201
204
225
206
220
204
231
230
233
207

235
234
212
232
228
222
204
205
206
225
220
204
231
230
232
210
229
211
201
207

235
220
234
231
230
212
233
201
212
241
204
206
207

DEVICE FOR STERILE FILLING OF CONTAINERS

This is a continuation-in-part of application Ser. No. 08/398,692, filed Mar. 6, 1995, now abandoned.

FIELD OF THE INVENTION

The present invention relates to devices for sterile filling of containers, especially before removal of the containers from the mold of blow molding machines used for manufacture of the containers.

BACKGROUND OF THE INVENTION

In known devices for filling containers in a sterile environment, costly measures must be constructed with great care to make sterile and keep sterile not only the filling tap or, if several containers are to be filled simultaneously, the filling taps, but also all of those parts which have surface areas in connection or coming into connection with the space surrounding the filling tap or taps. In this circumstance, the retaining block and the sterile filling chamber housing are to be considered first. To be able to sterilize the filling tap or taps, the floor of the sterile filling chamber housing, hereinafter indicated as the ASR housing, must first be removed, so that a hood surrounding the retaining block holding each filling tap can be mounted therein. Following cleaning, sterilization and drying of the passages of the filling tap and of its outside cover, the hood must be removed. Then great care must be taken that no microbes get into the filling tap or its surroundings. The same is true for the replacement of the floor of the ASR housing. The inside surface of the ASR housing and the outside surface of the retaining block in the known devices can be disinfected only with use of a disinfecting agent, because the steam or vapor to be used for sterilization cannot be introduced into the ASR housing.

SUMMARY OF THE INVENTION

Objects of the present invention include providing a device for sterile filling of containers, which facilitates completely automatic cleaning and sterilization of the filling tap or taps and all of those surfaces which are in contact with the space surrounding the filling tap or taps.

These objects are attained by a device for sterile filling of containers while still in a mold of a blow molding machine for manufacturing the containers, comprising a pressure resistant, filling chamber housing, a first retaining block, a movable shutter, apportioning means and retaining block drive means. The housing has sterilizable inner surfaces defining an interior and connection means for feeding and discharging cleaning fluid, pressurized vapor and sterile air into and from the housing and a floor coupled thereto. The first retaining block has a first filling tap and is movable in said housing in a longitudinal direction of the filling tap along a guide path. Seal means separates at least a part of the retaining block from the interior of the housing. A first opening is in the floor of the housing aligned with the first filling tap. The first filling tap is movable through the first opening to a position in which at least an end section of the first filling tap is outside the housing. The first movable shutter releasably seals the first opening and is mounted exteriorly of the floor. The apportioning means is coupled to the first filling tap, for dosing volumes of fluid for distribution through the first filling tap and into containers. The retaining block drive means drives the retaining block.

By the pressure-resistant construction of the ASR housing, the housing's connections for feeding and discharging cleaning fluid, vapor and sterile air and the shutter or shutters for the opening or openings in the floor of the ASR housing, the inside walls and outside walls of the retaining block and the filling tap or taps can be sterilized with cleaning fluid, vapor and sterile air. This sterilization procedure can be especially efficaciously and simultaneously performed with the sterilization of the filling tap or taps. Especially advantageously, the hood, which until now has been required for the filling tap, can be deleted and the floor of the ASR housing no longer need be removed before sterilization of the ASR housing and reinstalled after sterilization. Therefore, completely automatic cleaning and sterilization is possible for all of the necessary surfaces. Human contact with these surfaces is no longer required.

When the opening or openings in the floor of the ASR housing are closed, it is preferable to have an inflatable seal present between the outside of the floor of the ASR housing and the side of the movable shutter facing the housing floor. The movable shutter can advantageously be operated by a working cylinder, so that the shutter operation can also be included in the automation of the entire assembly.

In one improved embodiment, the apportioning device or means inside the ASR housing is arranged between the retaining block or blocks on one side and the filling tap or taps on the other side. This arrangement of the apportioning device within the ASR housing advantageously permits the apportioning device to be automatically cleaned and sterilized. Since a detachable connection can be provided for the floor of the ASR housing, preferably by means of its snap closings, when engagement with the apportioning device is required, for instance when an apportioning diaphragm must be exchanged, it is possible to move the apportioning device downward out of the ASR housing, after the housing floor has been removed.

When the ASR housing and its floor member houses the apportioning device and each retaining block has a cylindrical top part, as is preferably the case, the retaining block can be guided along the inside wall of the top cylindrical part. That arrangement is important for precise guiding of the tap. To guide the retaining block in its transfer from a top segment to a bottom segment, the retaining block advantageously has a portion of annular material projecting radially outwardly over or from the outside surfaces of both the top and the bottom segments. The annular material portion guides the block in the manner of a piston. Despite this guiding and the sealing effected through it, preferably together with an annular seal, it is guaranteed that the entire inside wall surface be cleaned and sterilized.

In one preferred embodiment, the area of the top part of the ASR housing receiving the top portion of the retaining block, when it is raised into its topmost position, is provided with at least one inlet and at least one outlet for cleaning fluid, vapor and sterile air. As a result, the volume of space in the ASR housing located above the guide of the retaining block can likewise be intensively cleaned and sterilized, as well as the volume of space lying beneath the guide arrangement.

In the interest of precise guiding, when the retaining block is completely lowered, the annular material portion is located at the level of the bottom end of the top part of the ASR housing. Also, a column-like or stanchion-like support is connected inflexibly or rigidly with the top end of the top part of the ASR housing and projects from the top downward into a central, longitudinal passage of the retaining block closed at its bottom end. The top segment of the retaining block is longitudinally slidably guided on the support, over a ball bearing.

The retaining block drive device preferably uses a hydraulic cylinder as drive element. With lowering of the pressure, no unintended and unexpected lowering of the retaining block can occur. In one preferred embodiment, a proportional control mechanism facilitates precise control of the movement of the retaining block and is associated with this hydraulic cylinder.

The device according to the present invention is for use in new machines, and is suitable for retrofitting, particularly considering that it has a high degree of cleaning chamber usefulness. Only two movable passages extend through to the inside chamber of the ASR housing. The seals of the passages slide on walls which limit the evacuable inside chamber of the ASR housing and can be cleaned and also sterilized.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF THE INVENTION

Figure 1:
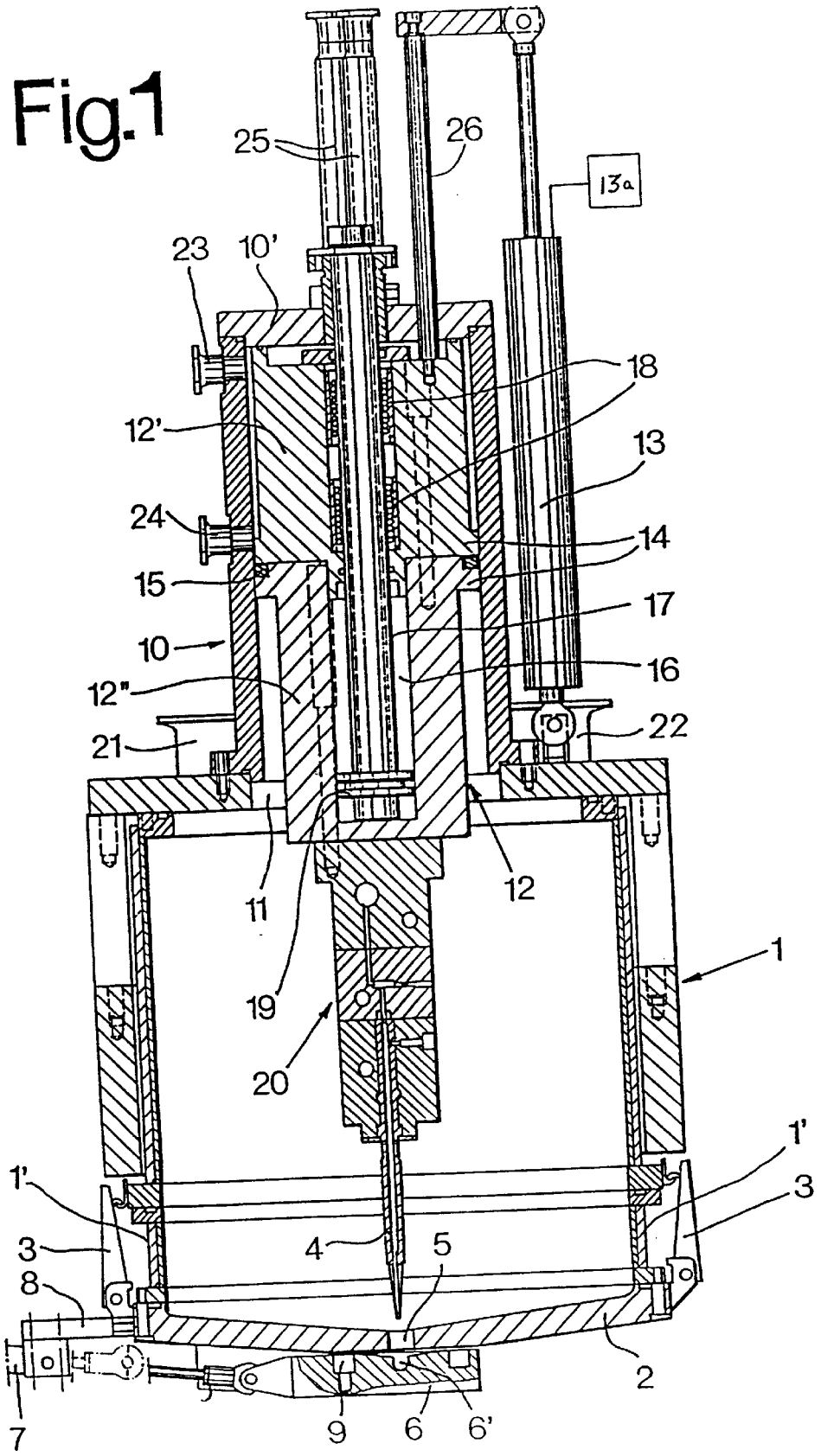
FIG. 1 is a side elevational view in section of an apparatus according to a first embodiment of the present invention with a filling tap in its top most setting.
Figure 2:
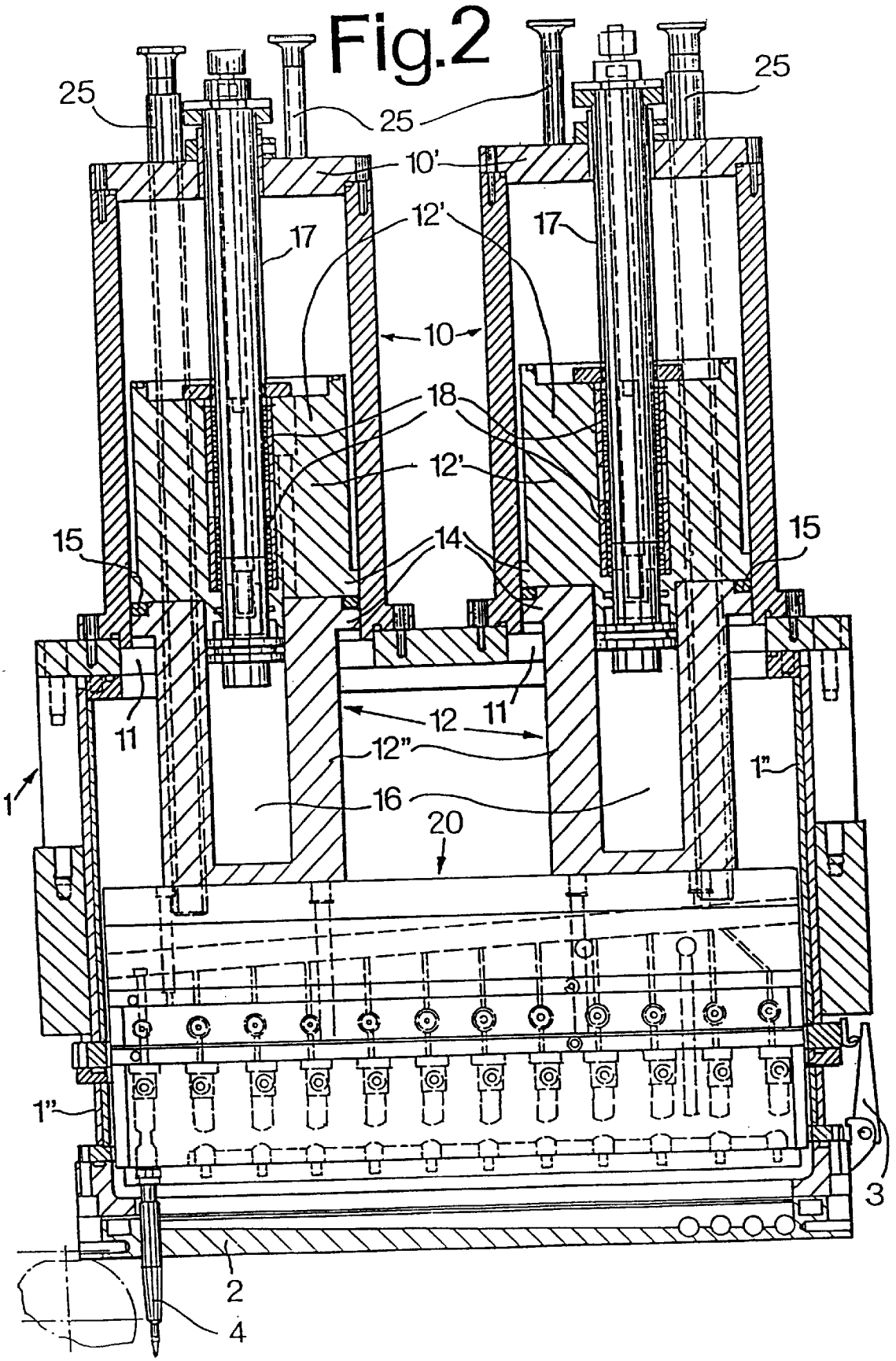
FIG. 2 is a front elevational view in section of the apparatus of FIG. 1, with the filling tap in its bottom most setting.
Figure 3:
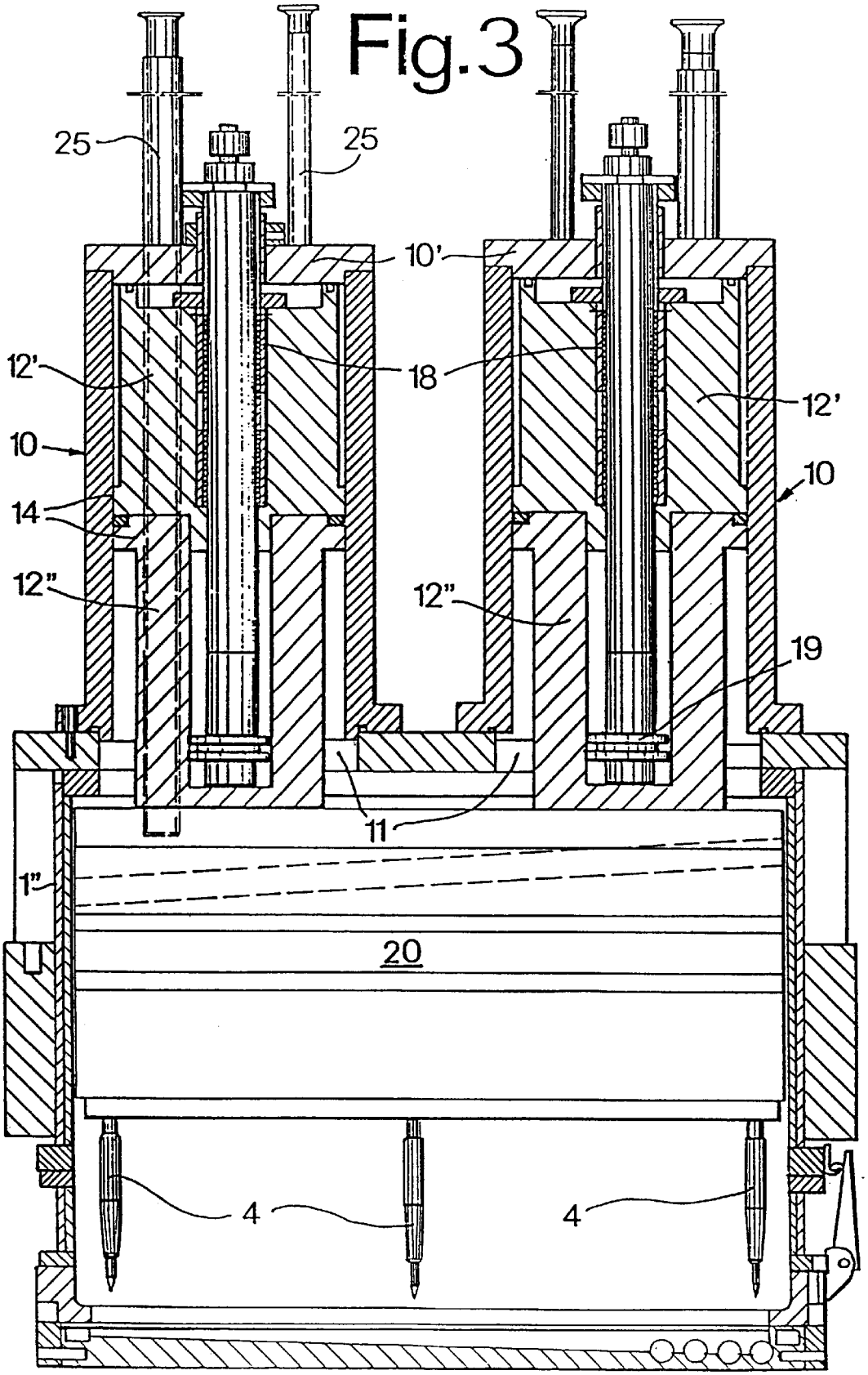
FIG. 3 is a front elevational view in section of the apparatus of FIG. 1, with the filling top in its top most setting.

Referring initially to FIGS. 1–3, a device or apparatus according to a first embodiment of the present invention, is for sterile filling of containers, especially for filling a series of ampules or bottles, before removal from the mold of a blow molding machine used for their manufacture. The device has a quadratic or rectangular bottom part 1 of a sterile filling chamber housing, hereinafter described as the ASR housing. The ASR housing is sealed closed on its bottom by a floor 2. Floor 2 is connected detachably with the ASR housing by snap closings 3, which closings may be configured as toggle bolts. The inside surface of floor 2, as shown in FIG. 1, is sloped from the two longitudinal sides 1' of bottom part 1 toward the middle.

For each filling tap 4, the middle of bottom part 1 is provided a passage opening 5. These passage openings 5 permit passage of the respective filling taps 4, and for discharge of cleaning fluid and vapor.

Passage openings 5 can be shut tightly or sealed closed by a shutter 6 provided on the bottom of floor 2. Shutter 6 can be slid by at least one working cylinder 7 between the closed setting illustrated in FIG. 1 and an unblocking or open setting in which shutter 6 is located in the vicinity of a retainer 8 provided on the side longitudinal border of floor 2. On its top side facing floor 2, shutter 6 is provided with a circumferential, closed groove 9. An inflatable sealing member 9*a* lies in groove 9 and is inflated when shutter 6 is moved into closed setting.

On the top of bottom part 1 in the vicinity of the two narrow ends 1", two identically configured top parts 10 are mounted. These parts have the shape of a cylindrical pot opening downwardly. The longitudinal axis of each top part extends perpendicular to the top of bottom part 1. Each top part 10 is aligned with an opening 11 in the top of bottom part 1 and is connected with the respective opening with a seal.

A retaining block 12 is slidably guided for longitudinal movement in each of the two top parts 10. These two identically configured retaining blocks 12 are movable by means of hydraulic cylinders 13. Each hydraulic cylinder is mounted outside of and adjacent to the respective top part 10, and is longitudinally movable. The hydraulic cylinder movements correspond to an up and down movement when integrated into the assembly of the device and are precisely controlled by a proportional control mechanism 13*a*.

In the transition area from a top segment 12' to a bottom segment 12" of retaining block 12, retaining block 12 has a radially outwardly projecting, annular material portion 14. Annular portion 14 is guided in the cylinder arrangement of the inside wall of top part 10. An annular seal, lying in a radially outwardly open annular groove 15 of material portion 14, seals the space located above the material portion 14 from the space located below material portion 14. The space located below material portion 14 is connected with the inside chamber of bottom part 1. As shown in FIG. 2, when retaining block 12 is in a completely lowered position, the material portion 14 is at the level of the end of top part 10 connected to bottom part 1. This lowest possible arrangement for guiding movement of retaining block 12 allows for great precision to be attained.

Retaining blocks 12 are provided with central blind-end bores 16 closed at bottom ends thereof. A support 17 extending from above downwardly is received in each bore 16 and is connected inflexibly with top part 10. The top segment 12' of each retaining block 12 is guided on the respective support 17 without any play and is positioned by means of a stainless ball bearing 18. This guide arrangement also contributes to attaining a high degree of precision. The bottom end of each support 17 has a guide piston 19 with a sealing ring therein engaging the inside wall of the respective bottom segment 12".

The two retaining blocks 12 support a block-like apportioning device 20 on the bottom of the blocks. The bottom of the apportioning device is directed toward floor 2 of the ASR housing, and has connections for filling taps 4. For each filling tap connection, apportioning device 20 incorporates the valves necessary for a time-pressure-apportioning cycle, which, in the exemplary embodiment, are in the form of diaphragm valves.

Two connection nozzles 21 and 22 are located on the top of bottom part 1 of the ASR housing. Cleaning fluid, vapor and sterilized air can be conducted through nozzles 21 and 22 for introduction into the ASR housing and discharge from the ASR housing. Each of the two top parts 10 of the ASR housing in that area, which receives one top segment 12' of one retaining block 12 in its topmost setting, has a top connection nozzle 23 and a bottom connection nozzle 24. Cleaning fluid, vapor and sterile air can be fed in and discharged through nozzles 23 and 24 in the same manner. In addition to the two connection nozzles 21 and 22, withdrawal nozzles (not shown) for taking samples for microbiological research and for particle counting can be provided.

As shown especially in FIG. 2, pipes 25, extending parallel to supports 17, pass through covers 10' limiting top parts 10 at their tops, and are connected with seals to the associated retaining blocks. Pipes 25 move together with retaining blocks 12 relative to the top part of the ASR housing. A seal is provided for each pipe in the area of the passage of pipes 25 through cover 10'.

Cleaning, sterilizing and drying are required before the device can be placed in operation. For these procedures, all retaining blocks 12 are first moved upwardly as far as they will go, i.e, to the setting shown in FIGS. 1 and 3, in which filling taps 4 are pulled completely upward out of passage openings 5 of floor 2. Shutters 6 are brought into closed settings as shown in FIG. 1. The closed setting is held with the inflatable sealing arrangement so that floor 2 is sealed tightly. Application of a tap hood to each tap and removal of the floor from the ASR housing, which is necessary when using conventional devices, is not required.

Cleaning fluid is introduced through connection nozzle 21, top connection nozzle 23 and tubes 25. Tubes 25 also serve to feed the products to be fed subsequently into the containers. The cleaning fluid cleans all of the passages of filling taps 4 and their conduits and also all of the wall surfaces of the ASR housing, retaining blocks 12 and apportioning device 20 which are in contact and can come into contact with the space surrounding filling taps 4. The cleaning fluid is discharged through connection nozzles 22 and bottom connection nozzles 24. If, as in the exemplary embodiment, the shutter is provided with a discharge passage 6', a portion of the cleaning fluid can also be discharged through passage 6.

After this cleaning, all parts are sterilized with vapor which can have a pressure up to 3 Bar. Because of the pressure-resistant construction of the ASR housing, the vapor can be fed into and discharged from the ASR housing through pipes 25 and through connection nozzles 21 and top connection nozzles 23. All of the inside walls of the ASR housing and all of the outside walls of apportioning device 20 and retaining blocks 12 are sterilized by the vapor. This is also true for the area located above the material portions 14 of retaining blocks 12, the supports projecting into the ASR housing, the outside of pipes 25 introduced through cover 10', and the operating rods 26 inserted through cover 10' by which hydraulic cylinder 13 drives retaining blocks 12. Consequently, all sealing mechanisms in the area of the passages as well as the seal of the material portions 14 move on a wall surface which can be cleaned and sterilized.

During the cleaning and sterilization, it is important to move retaining blocks 12 somewhat up and down. The vapor is conducted and released through the discharge passages of filling taps 4, through which air escapes from the container being filled during the filling process, through connection nozzles 22 and 24, as well as through discharge passage 6' to a condensate discharge.

Sterile air is blown in through connection nozzles 21 and 23 as well as through pipes 25 following sterilization. In this manner, a vacuum pressure does not occur through-out the cooling, and fluid residues can be removed simultaneously. A Level 100 atmosphere is thus provided inside the ASR housing.

The cleaning and sterilization can thus be carried out completely automatically, considerably increasing the certainty that no microbes come into contact with the inside surfaces of the ASR or any of the parts engaging the product being filled in the containers. With the conventional method, the operator must exercise extreme caution to avoid contaminating the above-noted surfaces and parts.

Although the apportioning device is included in the contact-free, automatic sterilization area no difficulties arise upon breakdown or for maintenance of the apportioning device, for example, to replace a diaphragm. For these purposes, floor 2, together with its shutter 6, can be removed by the snap closings without difficulty. Retaining blocks 12 can then be lowered to the bottom. Apportioning device 20 can then be brought down out of the ASR housing and become easily accessible.

Figure 4:
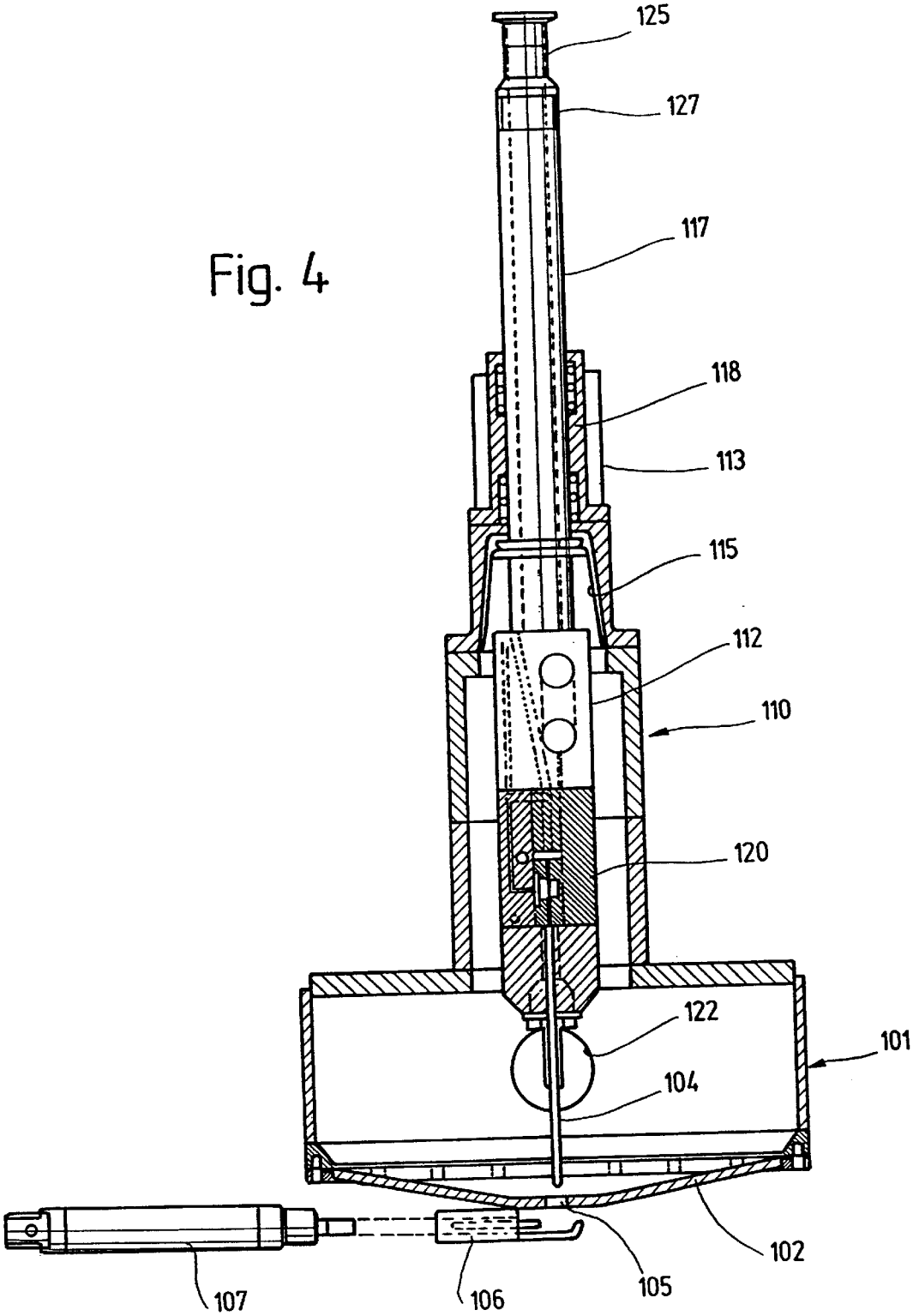
FIG. 4 is a side elevational view in section of an apparatus according to a second embodiment of the present invention, with a filling tap in its top most setting.
Figure 5:
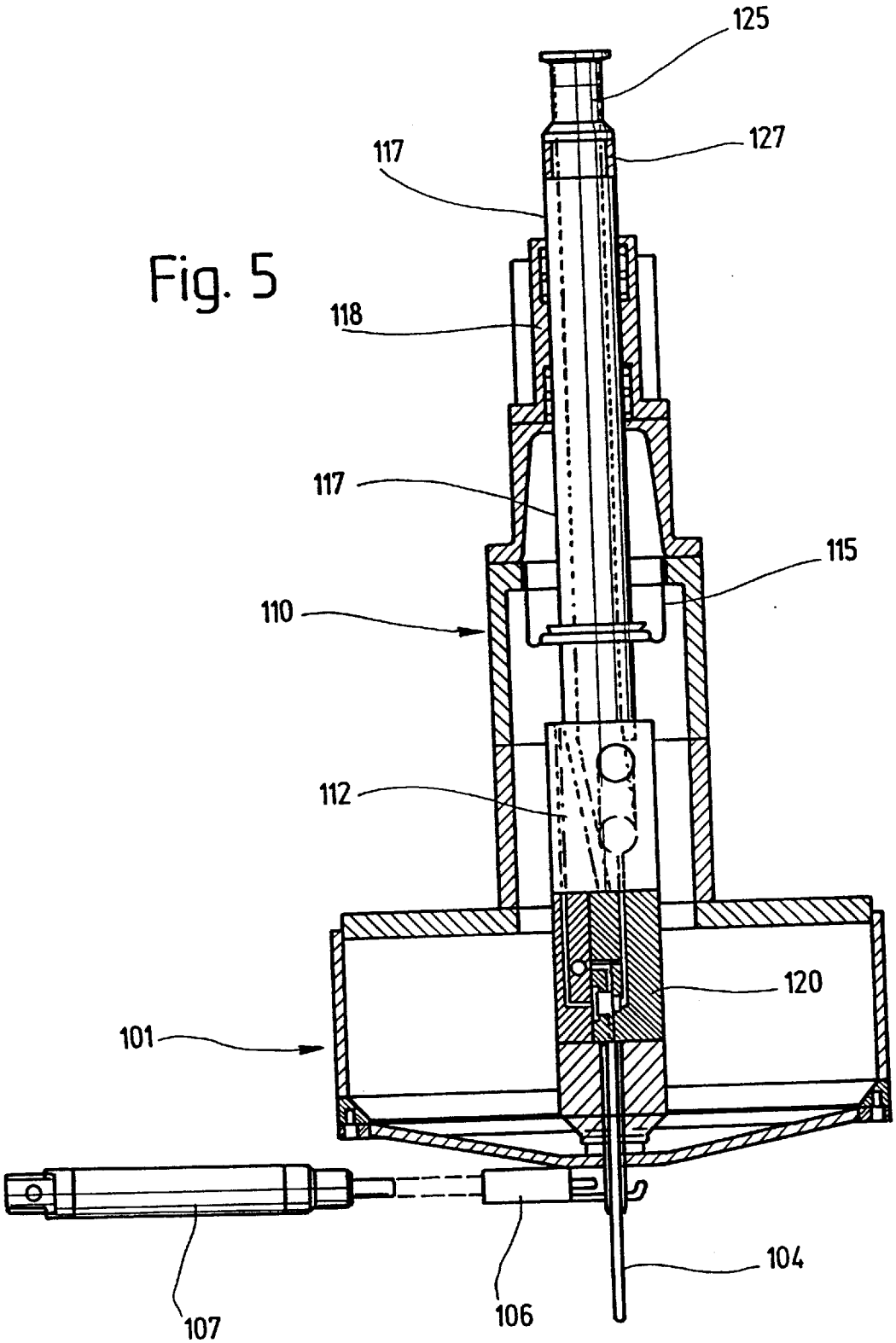
FIG. 5 is a side elevational view in section of the apparatus of FIG. 4, with the filling tap in its bottom most setting.

A second embodiment of the device according to the present invention is illustrated in FIGS. 4 and 5, wherein features corresponding to features of the first embodiment are identified with corresponding numbers increased by one hundred.

The sterile filling chamber housing, characterized more explicitly as an ASR housing incorporates a quadratic bottom part 101 and a number of filling taps 104 corresponding to the number of cylindrical or quadratic top parts 110. The ASR housing is sealed, inclusive of its quadratic bottom part 101. Bottom part 101 of this second embodiment is of lower height than bottom part 1 of the first embodiment. Thus, the space required for the housing is smaller and the weight of the housing is considerably lower than in the first embodiment. The ease of its maintenance is also increased. This lower height of bottom part 101 is attained by retaining block 112, and apportioning device 120 annexed at the retaining block bottom end being located in top part 110, when filling tap 104 is completely drawn back and upward, as shown in FIG. 4. Retaining block 112 serves as a filler material distributor, in the same manner as retaining block 12.

Furthermore, the second embodiment differs from the first embodiment in the guiding of retaining block 112 and the sealing of the interior chamber of the ASR housing from the surrounding environment. The top end of top part 110 is constructed of a plurality of parts, and is formed of a ball bearing bushing 118, in which a pipe 117 is guided for vertical movement without any play. Inside pipe 117, an interior pipe 125 is mounted. The filler material is guided into apportioning device 120 through interior pipe 125. The bottom end of pipe 117 is sealed and connected with coaxially arranged retaining block 112. Just above retaining block 112, a roll diaphragm 115 is connected with a seal to top pipe 117. At the other end, roll diaphragm 115 is connected with a seal to top part 110. A flange-like border is clamped between two coaxially arranged parts of top part 110. Roll diaphragm 115, as shown in FIGS. 4 and 5, hermetically seals the bottom chamber of the housing from its top chamber. Ball bearing bushing 118 is in contact with the surrounding atmosphere. The segment of pipe 117 in bushing 118 can come into contact with the surrounding atmosphere. Thus, only the interior chamber of the ASR housing below roll diaphragm 115 needs to be sterilized. A pipe 122 opens into the bottom part 101 in the second embodiment in the area of the side wall for introducing hot steam vapor and sterile air.

As in the first embodiment, during the sterilization, the passage openings 105 in floor 102 of bottom part 101 are closed by a shutter 106. Shutter 106 is moved by means of a working cylinder 107.

As in the first embodiment, a number of filling taps 104 are arranged in a row with some spacing from one another. Pipes 117 are connected with one another by a crossbar 127 adjacent their top ends. A hydraulic cylinder engages the crossbar to move all of the filling taps 104 up and down together. Since the second embodiment, as well as the first embodiment, is associated with a blow molding machine, and since the containers produced in a mold in this machine are being filled while they are still in the mold, the filling taps 104 can be moved downward beyond the floor 102 of the ASR housing, as shown in FIG. 5. The filler material is apportioned into the formed containers, preferably in the form of a time cycle pressure apportionment, by being fed out of the filling taps.

The setting of the filling taps 4 and 104 can only be corrected when the floor of the ASR housing is removed. Following a correction of the setting, a new sterilization must be undertaken, while operation of the blow molding machine is halted. Most often, the setting of the filling taps must be corrected when the filling taps also serve as calibrating taps. To calibrate a passage in the container produced by the blow molding machine, and the device according to the present invention is constructed so that the setting of the filling taps can be carried out at a point outside the sterile chamber. A third embodiment of the device according to the present invention, shown in FIGS. 6 and 7, offers this property.

Figures 6, 7:
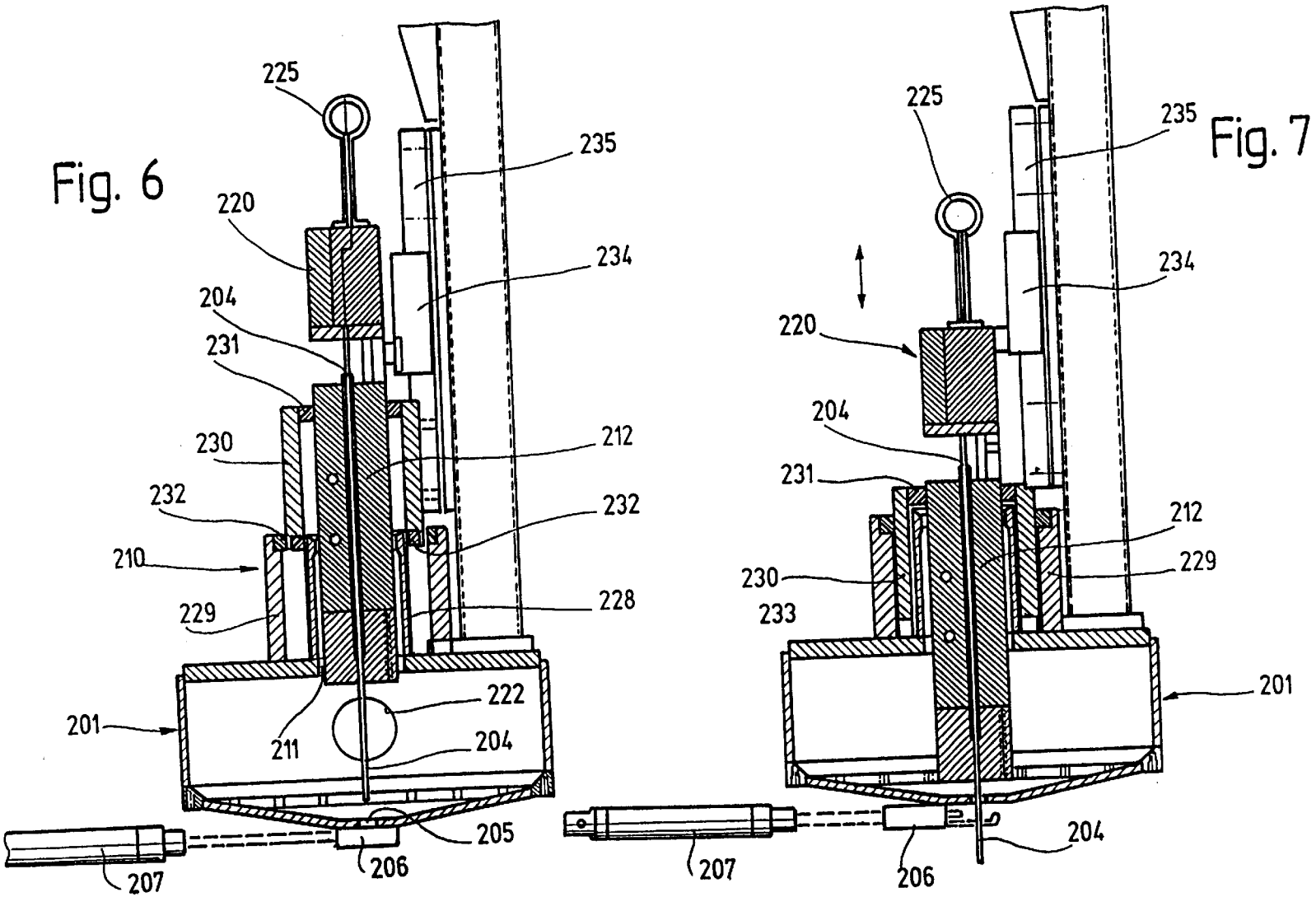
FIG. 6 is a side elevational view in section of an apparatus according to a third embodiment of the present invention, with a filling tap in its top most setting.
FIG. 7 is a side elevational view in section of the apparatus of FIG. 6, with the filling tap in its bottom most setting.

In the third embodiment, as in the second embodiment, corresponding parts are identified with numbers increased by one hundred from the corresponding features of the second embodiment. The bottom part 201 of the ASR housing does not differ from bottom part 101 of the second embodiment. It is also considerably smaller than in the first embodiment. Each filling tap 204 in bottom part 201 has a top part 210. The axial length of each top part is telescopically variable. A bottom segment has an interior wall 228 and an exterior wall 229 surrounding the interior wall at some lateral spacing therefrom. Both walls 228 and 229 are sealed at their bottom ends with bottom part 201, and are arranged coaxially to an opening 211 provided in the top end wall of the bottom part. An intermediate space, forming a rectangular stack between interior wall 228 and exterior wall 229, can receive a top segment 230 of top part 210, as shown in FIG. 7.

With formation of an intermediate space, top part 210 surrounds the retaining block 212 for filling tap 204. Filling tap 204 passes entirely through retaining block 212 along its longitudinal axis. At a shorter distance from the top end of retaining block 212, an inflatable seal 231 engages on its outside lateral surface. The other side of seal 231 engages at the top end of the top segment 230 of top part 210. For the extension and mounting or assembly of retaining block 212, the air is released from seal 231. As a result of the connection formed by the seal 231, the top segment 230 of top part 210 is moved up and down together with retaining block 212 during the production. A second inflatable seal 232 is installed at the top end of exterior wall 229. The other side of seal 232 engages the exterior lateral surface of top segment 230. A third inflatable seal 233 is installed at the bottom end of top segment 230. The other side of seal 233 engages the outside of interior wall 228. Therefore, the space connected with the interior of bottom part 201 and surrounding retaining block 212 is sealed off from the outside.

This setting of filling tap 204 can be adjusted or corrected at any time on the end of filling tap 204 projecting outward from the top end of retaining block 112. This point lies outside the sterile chamber and is accessible at any time.

This top end of filling tap 204 extends as far as the apportioning device 220 arranged at some distance above retaining block 212. Filling tap 204 is fed with filler material through a pipe 225. Apportioning device 220, together with the top end of the retaining block, is connected with a guiding carriage arrangement 234. Carriage arrangement 234 is guided moving in the direction of movement of retaining block 212 by guide bars or tracks 235.

As in the first and second embodiments, when several filling taps are arranged in a row at some spacing from one another, the top parts are constructed and arranged to support the retaining blocks and the associated apportioning devices in the same manner.

During the sterilization of all parts, hot steam is conducted through a pipe 222 into the ASR housing. As shown in FIG. 6, filling taps 204 are withdrawn upward. The passage openings 205 are closed off by means of the shutters. A pressure is generated in the interior of both bottom part 201 and top part 210. During the sterilization the inflatable seal 231 is inflated as it is during production, and therefore, is operational. The inflatable second seal 232 is pressure-balanced (not inflated) during production, and is inflated during sterilization. Inflatable third seal 233 is inflated during production and is pressure-balanced during sterilization. During production, sterile air is blown into the bottom part 201 of the ASR housing. The air also penetrates into the chambers between retaining block 212 and the interior wall 228 as well as between wall 228 and the top segment 230. A steam barrier is introduced into the chamber between interior wall 228 and top segment 230 during production. The same as with all of the other embodiments, the ASR housing is here configured to be pressure-resistant.

Figure 9:
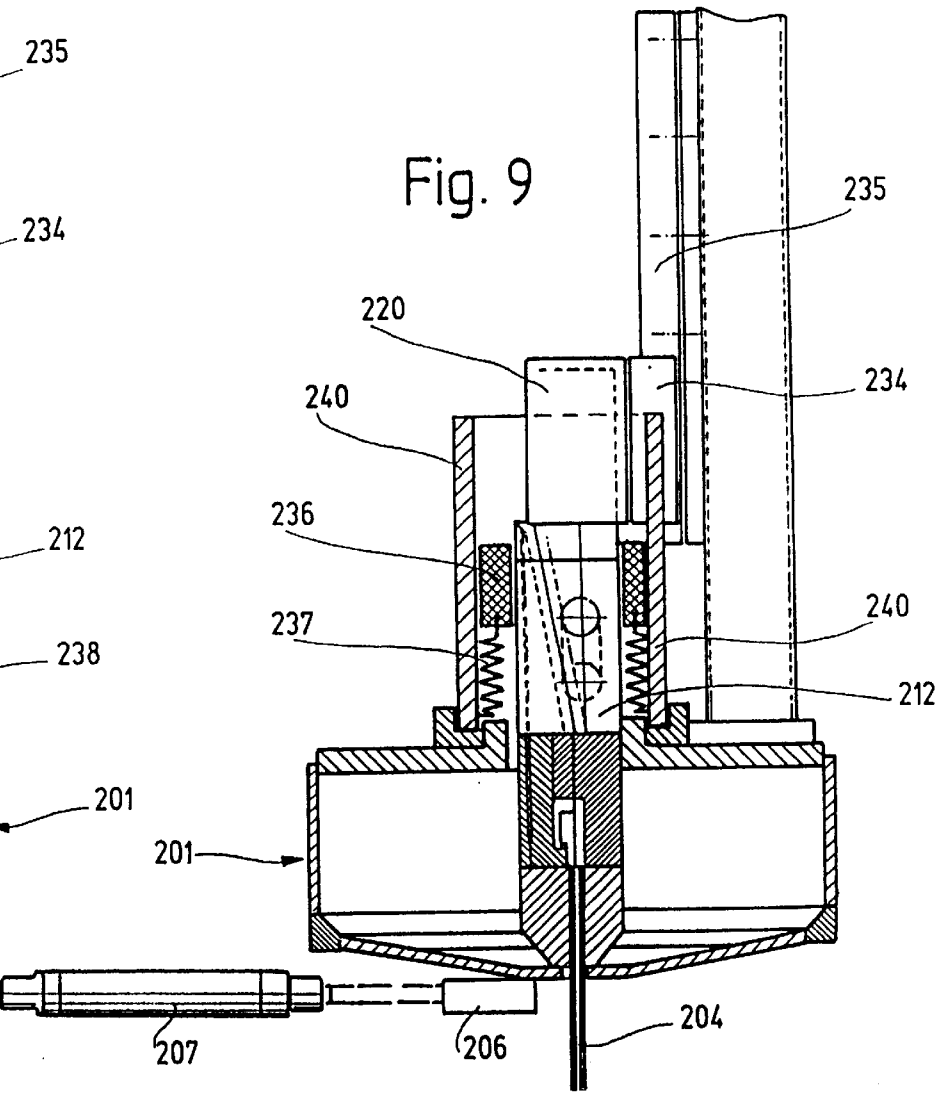
FIG. 9 is a side elevational view in section of the apparatus of FIG. 8, with the filling tap in its bottom most setting.
Figure 8:
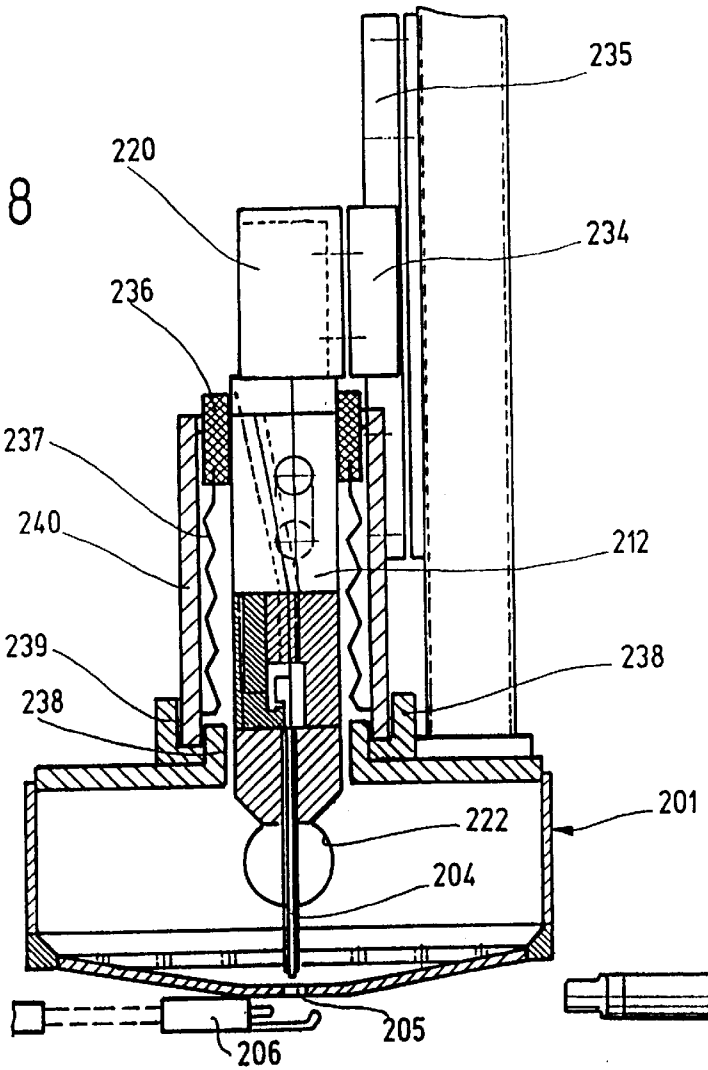
FIG. 8 is a side elevational view in section of an apparatus according to a fourth embodiment of the present invention, with a filling tap in its top most setting.

The fourth embodiment of the present invention is shown in FIGS. 8 and 9. In the same manner as the embodiment shown in FIGS. 6 and 7, the device is modified to obviate the requirement for steam barrier vapor to be fed in during the production. Since the embodiment of FIGS. 8 and 9 partially corresponds with that of FIGS. 6 and 7, corresponding parts are referenced with identical reference numbers. Additionally, the embodiment of FIGS. 8 and 9 is explained only insofar as it differs from the embodiment of FIGS. 6 and 7.

Adjacent the top end of retaining block 212, an annular element 236 is engaged on the retaining block with a seal. Annular element 236 is connected to the top end of a bellows 237. Bellows 237 surrounds retaining block 212 with some distance between the two, and is sealed with bottom part 201 at its bottom end. In the embodiment shown, for this purpose two concentric clamping rings 238 and 239 are installed on bottom part 201. With the up and down movement of retaining block 212, filling tap 204 extending through the retaining block and apportioning device 220 connected to the retaining block and the filling tap, bellows 237 modifies its length correspondingly, as shown in FIGS. 8 and 9.

Because of the pressure generated in bottom part 201 and in the space between bellows 237 and retaining block 212 during the sterilization by the vapor introduced into the ASR housing, bellows 237 is arranged in a supporting sheathing 240. Supporting sheathing 240 surrounds the bellows such that the interior lateral surface of the sheathing can support bellows 237.

Figure 10:
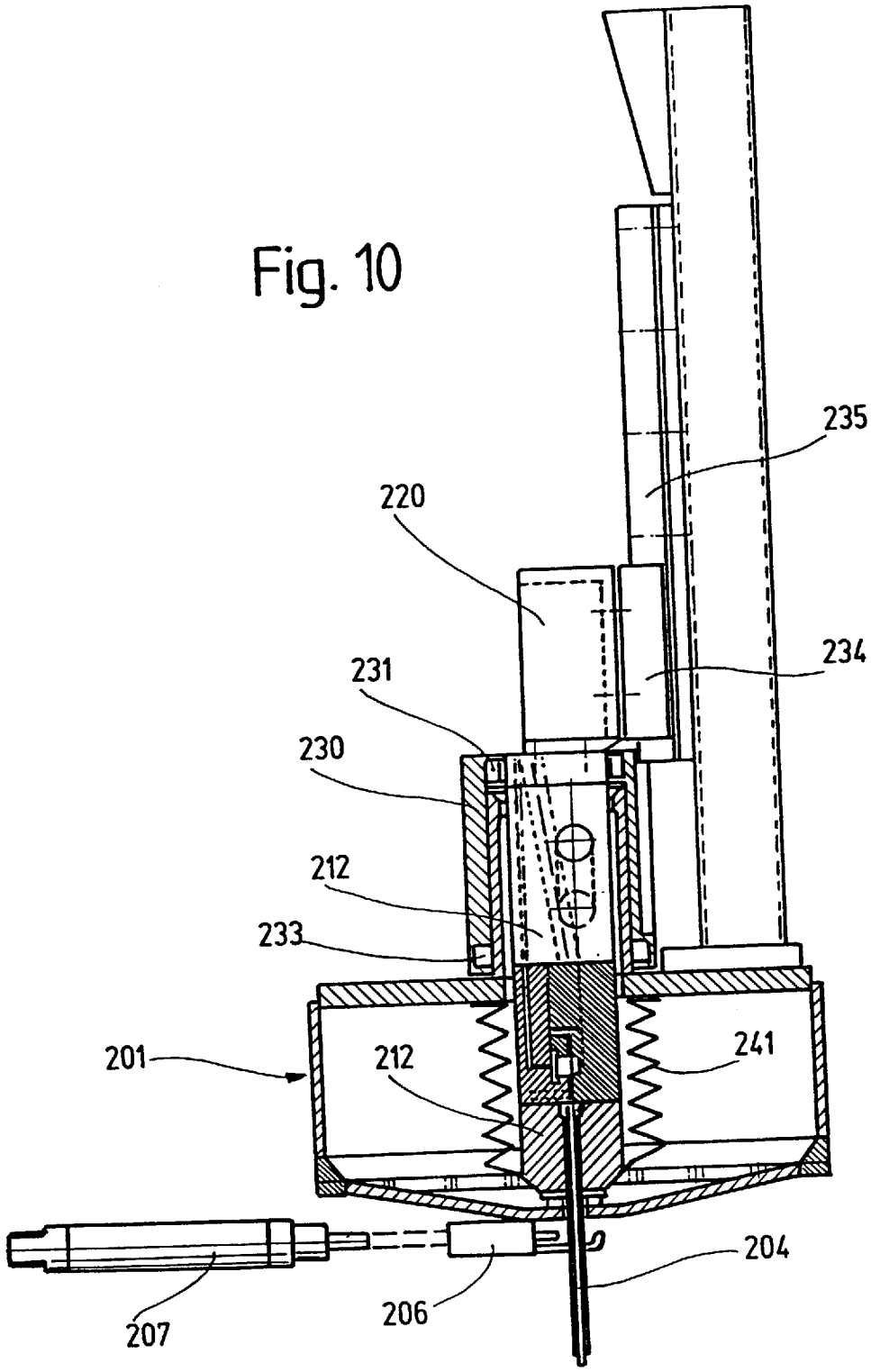
FIG. 10 is a side elevational view in section of an apparatus according to a fifth embodiment of the present invention, with a filling tap in its bottom most setting.

The fifth embodiment of the present invention shown in FIG. 10 comprises another modification of the embodiment shown in FIGS. 6 and 7. Only the differences relative to the fourth embodiment are explained. Identical reference numbers are used for identical parts. The essential difference from the fourth embodiment of FIGS. 6 and 7 resides in the arrangement of bellows 241. One or bottom end of bellows 241 is connected with the bottom end of retaining block 212 and is sealed closed. The other or top end of bellows 241 is seal-connected with the bottom part top concentric to the opening 211 in the top of bottom part 201. Bellows 241 is then located in the interior of bottom part 201 and shields the entire retaining block 212. The top part 210 is variable in length, and need only have a bottom segment 229 seal-connected with bottom part 201 and a top segment 230 surrounding the bottom segment and longitudinally slidably guided in it. An inflatable seal 231 between the top end of top segment 230 and the top end of retaining block 212, as well as an inflatable seal 233 at the bottom end of top segment 230 mounted on the bottom segment, are then sufficient. However, top part 210 can also be omitted, since its protective effect is not required because of bellows 241.

In the case of pressure in bottom part 201 generated by the steam vapor introduced during sterilization or the sterile air introduced during production, bellows 241 can be supported on retaining block 212.

In all of the embodiments, the ASR housing is constructed to be pressure-resistant. Also, as shown in FIG. 10, during production, filling tap 204 projects downward out of bottom part 201. The setting of filling tap 204 at the top end of retaining block 212 can be corrected, as is also the case in the embodiment shown in FIGS. 6 and 7, as required.

While various embodiments have been chosen to illustrate the invention, it will be understood by those skilled in the art that various changes and modifications can be made therein without departing from the scope of the invention as defined in the appended claims.

What is claimed is:

1. A device for sterile filling of containers while still in a mold of a blow molding machine for manufacturing the containers, comprising:

a pressure resistant, filling chamber housing having sterilizable inner surfaces defining an interior and connection means for feeding and discharging cleaning fluid, pressurized vapor and sterile air into and from said housing, said housing having a floor coupled thereto and being located in an exterior environment;

a first retaining block having a first filling tap and being movable in said housing in a longitudinal direction of said filling tap along a guide path;

sealing means for separating at least a part of said retaining block from one of said exterior environment and said interior of said housing;

a first opening in said floor of said housing aligned with said first filling tap, said first filling tap being movable through said first opening to a position in which at least an end section of said first filling tap is outside said housing;

a first movable shutter for releasably sealing said first opening mounted exteriorly of said floor;

apportioning means, coupled to said first filling tap, for dosing volumes of fluid for distribution through said first filling tap and into containers; and a retaining block drive means for driving said retaining block.

2. A device according to claim 1 wherein an inflatable seal is positioned between an outside surface of said floor of said housing and said shutter.

3. A device according to claim 1 wherein working cylinder means is coupled to said shutter for moving said shutter between open and closed positions.

4. A device according to claim 1 wherein said apportioning means is located inside said housing with said retaining block on one side thereof and said first filling tap on an opposite side thereof.

5. A device according to claim 4 wherein snap closing means detachably connects said floor to a bottom end of said housing.

6. A device according to claim 4 wherein said housing comprises a bottom part receiving said apportioning means and a cylindrical top part receiving a retaining block, said cylindrical top part having an inside wall engaging and guiding movement of said retaining block.

7. A device according to claim 6 wherein said retaining block comprises a top segment, a bottom segment and an annular material portion between said top and bottom segments, said annular material portion projecting radially outwardly from outside surfaces of said top and bottom segments; and said top part of said housing receives said top segment of said retaining block in a top most position of said retaining block, and comprises of inlet means and outlet means for feeding and discharging fluid, vapor and sterile air adjacent said top segment when said top segment is in said top most position.

8. A device according to claim 7 wherein said annular material portion of said retaining block comprises an annular groove on an outer surface thereof, said annular groove receiving an annular seal engaging said annular material portion and said inside wall of said cylindrical top part of said housing.

9. A device according to claim 7 wherein said retaining block is movable between upper and lower positions;

in said lower position of said retaining block, said annular material portion is located adjacent a bottom end of said top part of said housing;

said retaining block comprises a central longitudinal passage receiving a cylindrical support depending from and fixedly connected to a top end of said housing; and said top segment of said retaining block has a ball bearing bushing in said central longitudinal passage thereof guided for longitudinal sliding over said cylindrical support.

10. A device according to claim 1 wherein said retaining block drive means comprises a hydraulic cylinder as a drive element thereof.

11. A device according to claim 10 wherein said hydraulic cylinder is associated with proportional control means.

12. A device according to claim 1 wherein said sealing means comprises a roll diaphragm located in said interior of said housing sealed at one end to said housing and at another end with a guiding element supporting said retaining block.

13. A device according to claim 12 wherein said guiding element comprises a pipe slidably guided without play in a ball bearing bushing for movement along a longitudinal axis of said pipe; and said ball bearing bushing is connected to said housing.

14. A device according to claim 1 wherein said housing comprises a top part which is longitudinally variable in said longitudinal direction;

said retaining block and said filling tap project over and beyond a top end of said top part;

said sealing means seals said top end of said top part to a top end segment of said retaining block; and said apportioning means is arranged outside of said housing.

15. A device according to claim 14 wherein said top part of said housing comprises first and second segments which are telescopically connected; and said sealing means comprises a sealing element between said first and second segments of said housing.

16. A device according to claim 15 wherein said first segment comprises an exterior wall and an interior wall forming a circumferential chamber therebetween which receives said second segment; and said sealing means is located between one of said walls and said second segment.

17. A device according to claim 15 wherein said sealing means comprise inflatable seals.

18. A device according to claim 1 wherein said sealing means comprises a bellows having a first end sealed to said retaining block and a second end sealed to said housing.

19. A device according to claim 18 wherein said bellows is arranged outside said housing; and said first end of said bellows is sealed to a top end segment of said retaining block.

20. A device according to claim 19 wherein said bellows is surrounded by a supporting sheathing.

21. A device according to claim 18 wherein said bellows is located within said interior of said housing; and said first end of said bellows is sealed to a bottom segment of said retaining block.

22. A device according to claim 1 wherein said filling tap comprises an upper end directed away from said first opening and located outside said housing.

23. A device according to claim 1 wherein said apportioning means is located outside said housing.

* * * * *